US011040554B2

(12) United States Patent
Kato

(10) Patent No.: US 11,040,554 B2
(45) Date of Patent: Jun. 22, 2021

(54) PRINTER INCLUDING FIRST LINK, SECOND LINK, AND CONNECTION MEMBER FOR MOVING PLATEN HOLDER IN ACCORDANCE WITH MOVEMENT OF OPERATION MEMBER

(71) Applicant: BROTHER KOGYO KABUSHIKI KAISHA, Nagoya (JP)

(72) Inventor: Nobuo Kato, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/825,528

(22) Filed: Mar. 20, 2020

(65) Prior Publication Data

US 2020/0391523 A1 Dec. 17, 2020

(30) Foreign Application Priority Data

Jun. 12, 2019 (JP) ..... JP2019-109647

(51) Int. Cl.
*B41J 29/00* (2006.01)
*B41J 11/04* (2006.01)
*B41J 2/32* (2006.01)

(52) U.S. Cl.
CPC ..... *B41J 11/04* (2013.01); *B41J 2/32* (2013.01); *B41J 29/00* (2013.01); *B41J 2202/31* (2013.01)

(58) Field of Classification Search
CPC . B41J 11/04; B41J 2/32; B41J 2202/31; B41J 3/4075
See application file for complete search history.

(56) References Cited

U.S. PATENT DOCUMENTS 8,197,060 B2 * 6/2012 Maekawa ..... B41J 15/042 347/108
8,651,757 B2 * 2/2014 Inoue ..... B41J 11/04 400/691
2007/0138193 A1 * 6/2007 Aono ..... B41J 29/13 220/810
2011/0107932 A1 * 5/2011 Inoue ..... B41J 11/04 101/248
2016/0176209 A1 * 6/2016 Ishimori ..... B41J 15/04 347/104

FOREIGN PATENT DOCUMENTS

JP H04-166373 A 6/1992

* cited by examiner

*Primary Examiner* — Huan H Tran
(74) *Attorney, Agent, or Firm* — Kenealy Vaidya LLP

(57) ABSTRACT

A printer includes: a housing; a platen holder; a platen roller; a printing head; an operation member; a first link; a second link; a connection member having a connecting portion connecting the first link to the second link; and a movable member moving the platen holder in response to a pivotal movement of the second link to move the platen roller toward and away from the printing head. When the operation member is moved within a first movable range, the second link is pivotally moved while the first link and the connecting portion are maintained at a first positional relationship. When the operation member is moved within a second movable range different from the first movable range, a positional relationship between the first link and the connecting portion is changed from the first positional relationship to a second positional relationship while the second link is maintained stationary.

7 Claims, 7 Drawing Sheets

PRINTER INCLUDING FIRST LINK, SECOND LINK, AND CONNECTION MEMBER FOR MOVING PLATEN HOLDER IN ACCORDANCE WITH MOVEMENT OF OPERATION MEMBER

CROSS REFERENCE TO RELATED APPLICATION

This application claims priority from Japanese Patent Application No. 2019-109647 filed Jun. 12, 2019. The entire content of the priority application is incorporated herein by reference.

TECHNICAL FIELD

The present disclosure relates to a printer.

BACKGROUND

There has been known a printer in which a positional relationship between a platen roller and a printing head is changed in accordance with a pivotal movement of a cover. For example, Japanese Patent Application No. H04-166373 discloses a facsimile including a cover member and a release cam. In this facsimile, an engagement pin of the cover member is releasably engaged with an engagement groove formed in the release cam to transmit a force generated by an opening/closing operation of the cover member to the release cam. As the release cam is pivotally moved, a recording head is moved in a direction away from a platen or approaches the platen.

SUMMARY

With the facsimile described above, however, the engagement pin is brought into disengagement from the engagement groove during the opening operation of the cover member. Therefore, if a posture of the release cam has been changed for some reason while the cover member is open, the engagement pin may fail to be engaged with the engagement groove in the closing operation of the cover member. That is, this configuration may hinder the positional relationship between the platen and the recording head from being stably changed in accordance with the opening/closing operation of the cover member.

In view of the foregoing, it is an object of the present disclosure to provide a printer in which a positional relationship between a platen roller and a printing head can be stably changed in accordance with a movement of an operation member operated by a user.

In order to attain the above and other objects, according to one aspect, the disclosure provides a printer including: a housing; a platen holder; a platen roller; a printing head; an operation member; a first link; a second link; a connection member; and a movable member. The platen holder is accommodated in the housing and is movable between a pressure position and a retracted position. The platen roller is rotatably supported by the platen holder. The printing head is configured to nip a printing medium in cooperation with the platen roller to perform printing on the printing medium. The platen roller presses the printing head when the platen holder is at the pressure position. The platen roller is spaced apart from the printing head when the platen holder is at the retracted position. The operation member is provided at the housing and is movable relative to the housing within a first movable range and within a second movable range different from the first movable range. The first link is pivotally movably supported by the operation member. The first link has a first portion and a second portion different from the first portion. The second link is supported by the housing and is pivotally movable between an operation position and a standby position. The connection member has a connecting portion at which the first link and the second link are connected to each other. The first link and the connecting portion provides therebetween a positional relationship including a first positional relationship at the first portion of the first link and a second positional relationship at the second portion of the first link. The movable member is movable in interlocking relation to a pivotal movement of the second link from the operation position to the standby position to move the platen holder from the pressure position to the retracted position. When the operation member is moved within the first movable range, the connection member causes the second link to be pivotally moved from the operation position to the standby position in response to a pivotal movement of the first link while maintaining the first positional relationship between the first link and the connecting portion. When the operation member is moved within the second movable range, the connection member causes the positional relationship between the first link and the connecting portion to be changed from the first positional relationship to the second positional relationship in response to the pivotal movement of the first link while maintaining the second link at the standby position.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
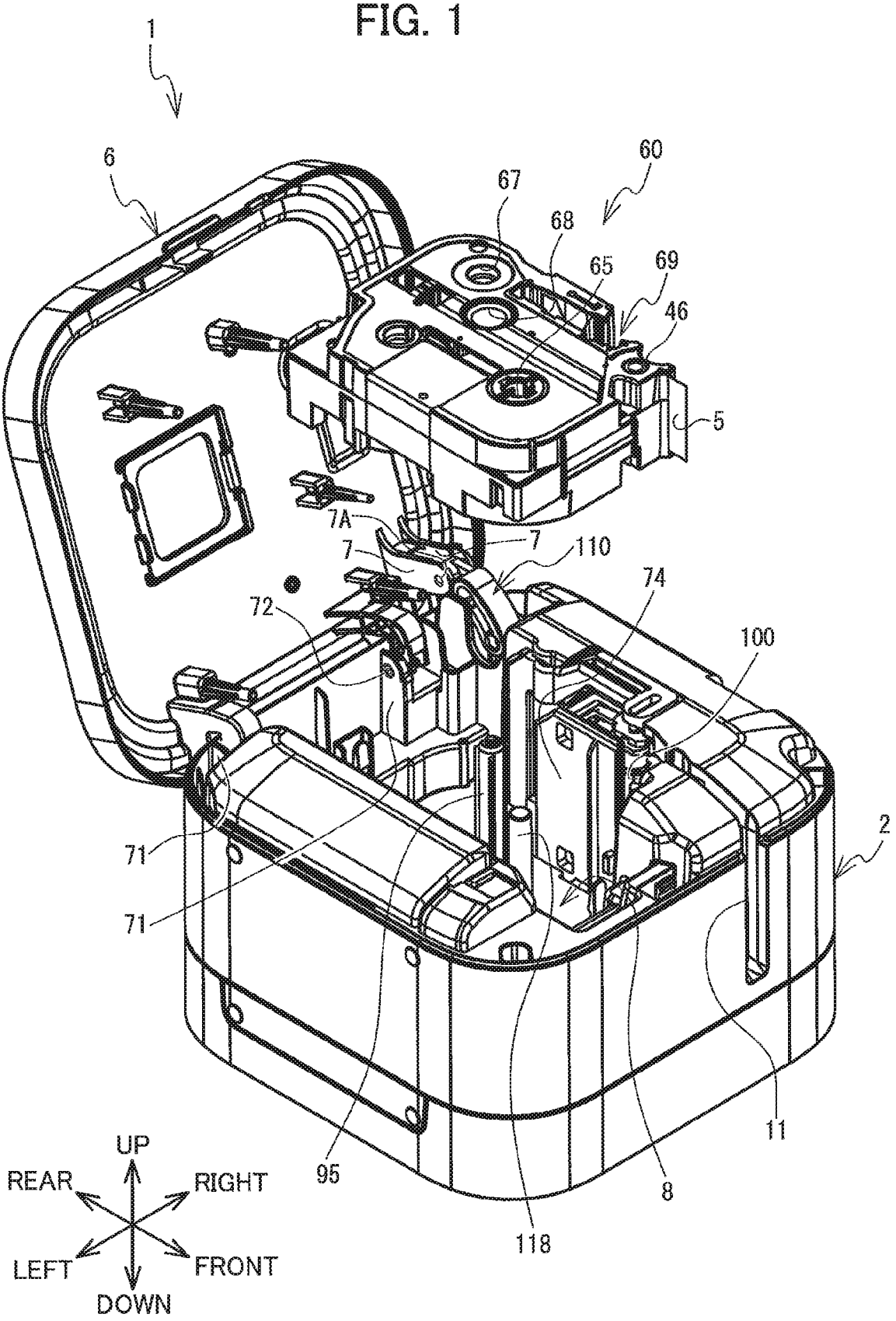
FIG. 1 is a perspective view of a printer according to one embodiment of the present disclosure and a tape cassette attachable to the printer.

Hereinafter, one embodiment of the present disclosure will be described while referring to the accompanying drawings. Note that the terms "upward", "downward", "leftward", "rightward", "frontward" and "rearward" appearing in the following description correspond to the terms "up", "down", "left", "right", "front" and "rear" shown in the drawings, respectively.

First, a configuration of a printer 1 according to the embodiment will be described with reference to FIGS. 1 to 4C. As illustrated in FIG. 1, the printer 1 includes a housing 2 having a substantially rectangular parallelepiped shape. The housing 2 is formed with an attachment portion 8 that is open upward. A tape cassette 60 including a printing medium 5 is attachable to and detachable from the attachment portion 8. Further, a right portion of a front surface of the housing 2 is formed with a discharge opening 11 that allows the printing medium 5 to be discharged outside of the housing 2 therethrough. A cutting mechanism (not illustrated) is disposed within the housing 2 at a position rearward of the discharge opening 11. The cutting mechanism is configured to cut the printing medium 5. The attachment portion 8 is an example of an opening.

In one example, the tape cassette 60 is a receptor type. The tape cassette 60 has support holes 65 and 67 and a head opening 69, and includes a ribbon take-up spool 68 and a tape drive roller 46. Although not illustrated in the drawings in detail, the support hole 65 rotatably supports a tape spool around which the printing medium 5 is wound, and the support hole 67 rotatably supports a ribbon spool around which an unused ribbon is wound. The ribbon take-up spool 68 has a hollow cylindrical shape and is rotatable to take up a used ribbon. The tape drive roller 46 has a hollow cylindrical shape and is rotatable. The head opening 69 penetrates the tape cassette 60 in an up-down direction, and is open rightward. Within the head opening 69, the ribbon and the printing medium 5 are superposed on each other so that the ribbon is positioned to the left of the printing medium 5.

Figure 2:
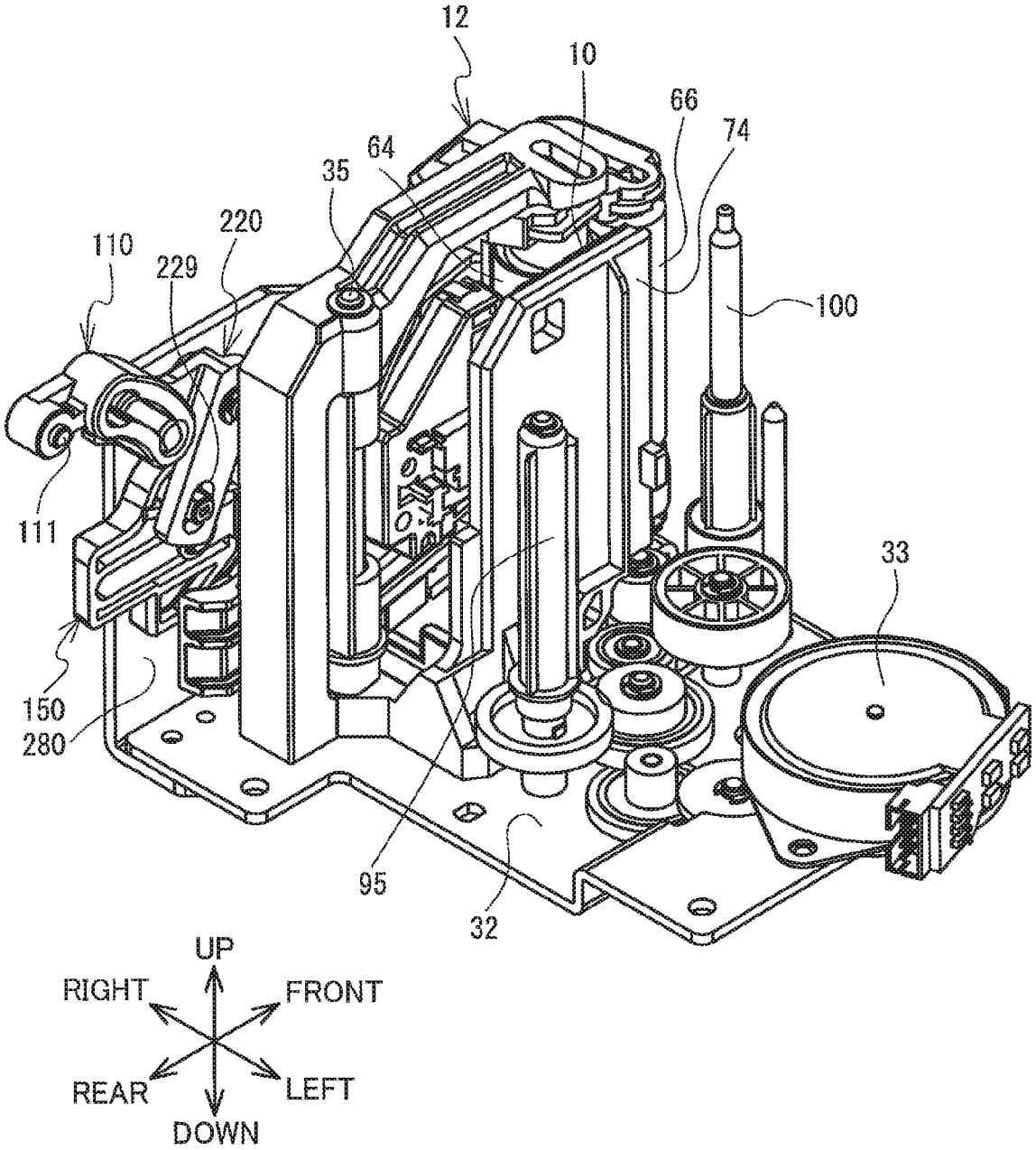
FIG. 2 is a perspective view of a platen holder, a platen roller, and a conveying roller in the printer according to the embodiment.

As illustrated in FIG. 1, the housing 2 includes an auxiliary shaft 118 extending upward from a bottom portion of the attachment portion 8. Further, as illustrated in FIG. 2, a support plate 32 is provided at a position below the bottom portion of the attachment portion 8. A ribbon take-up shaft 95, a drive shaft 100, and a head holder 74 are provided on the support plate 32 so as to extend upward from the support plate 32 into the attachment portion 8.

In a state where the tape cassette 60 is attached to the attachment portion 8, the ribbon take-up shaft 95 is inserted into the ribbon take-up spool 68, the auxiliary shaft 118 is inserted into the support hole 65, and the drive shaft 100 is inserted into the tape drive roller 46. In this state, the ribbon take-up shaft 95 and the drive shaft 100 are drivingly connected to a conveying motor 33 (see FIG. 2) provided on the support plate 32.

Further, in the state where the tape cassette 60 is attached to the attachment portion 8, the head holder 74 is inserted into the head opening 69, and the printing medium 5 is accommodated in the attachment portion 8. FIG. 2 illustrates a printing head 10 provided on a right surface of the head holder 74. In the present embodiment, the printing head 10 a thermal head provided with a plurality of heat generating elements arranged in the up-down direction.

A platen holder 12 is accommodated within the housing 2. The platen holder 12 extends in a front-rear direction, and has a rear end portion pivotally movably supported by a support shaft 35 provided on the support plate 32. Specifically, the platen holder 12 is pivotally movable about the support shaft 35 between a pressure position (see FIG. 2) and a retracted position. The platen holder 12 rotatably supports a platen roller 64 and a conveying roller 66. The platen roller 64 is positioned to face the printing head 10. In a state where the tape cassette 60 is attached to the attachment portion 8, the conveying roller 66 faces the tape drive roller 46 of the tape cassette 60.

When the platen holder 12 is in the pressure position, the platen roller 64 presses the printing head 10, and the conveying roller 66 presses the tape drive roller 46. In this state, the printing medium 5 and the ribbon superposed on each other are nipped at a portion between the platen roller 64 and the printing head 10 while the ribbon is positioned rightward of the printing medium 5. Further, the printing medium 5 is nipped at a portion between the conveying roller 66 and the tape drive roller 46. The ribbon is conveyed to an inner space of the tape cassette 60 through a portion between the head opening 69 and the tape drive roller 46, and is taken up by the ribbon take-up spool 68.

When the platen holder 12 is in the retracted position, the platen roller 64 is positioned rightward of the printing head 10 to be spaced apart from the printing head 10, and the conveying roller 66 is positioned rightward of the tape drive roller 46 to be spaced apart from the tape drive roller 46. As the platen holder 12 is pivotally moved from the retracted position to the pressure position, the platen roller 64 is brought into driving connection to the conveying motor 33.

An inclined portion (not illustrated) is provided on a right end portion of the platen holder 12. The inclined portion is inclined frontward as extending from the left side toward the right side. The platen holder 12 is urged by a torsion spring (not illustrated) in the counterclockwise direction toward the retracted position about the support shaft 35 as viewed in a plan view. This configuration causes the inclined portion of the platen holder 12 to be pressed against a rotary roller 82 (see FIG. 3) provided in a movable member 150 (described later).

As illustrated in FIG. 1, a pair of pivot portions 71 is provided at a rear portion of the housing 2. Each of the pair of pivot portions 71 has a substantially U-shape as viewed in a front view. The pair of pivot portions 71 respectively supports a pair of shafts 72 each extending in a left-right direction. The pair of shafts 72 supports a cover 6 so as to be pivotally movable relative to the housing 2. The cover 6 can open and close the attachment portion 8 that serves an opening accommodating therein the printing medium 5 in accordance with a pivotal movement of the cover 6.

In response to a user's operation, the cover 6 is pivotally movable between a closed position (see FIG. 4A) and an open position (see FIG. 1). When the cover 6 is in the open position, the attachment portion 8 is open upward. When the cover 6 is in the closed position, the attachment portion 8 is closed by the cover 6. The cover 6 is an example of an operation member.

Figure 4A:
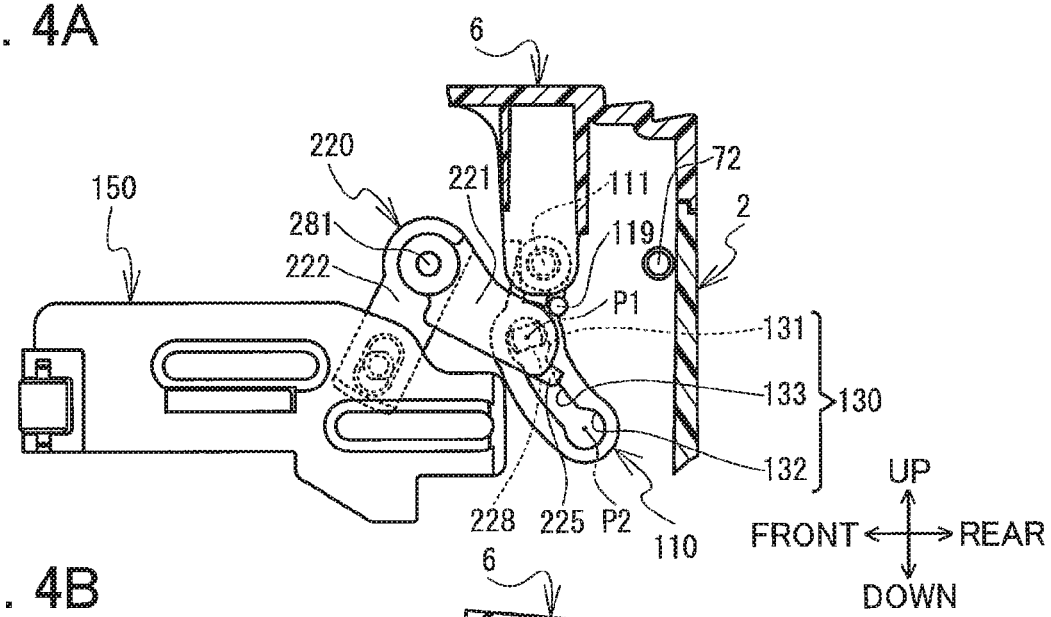
FIG. 4A is an explanatory view for explaining how a cover in the printer according to the embodiment is moved within a first movable range, and particularly illustrating a state where the cover is in its closed position and the second link is in its operation position.
Figure 4B:
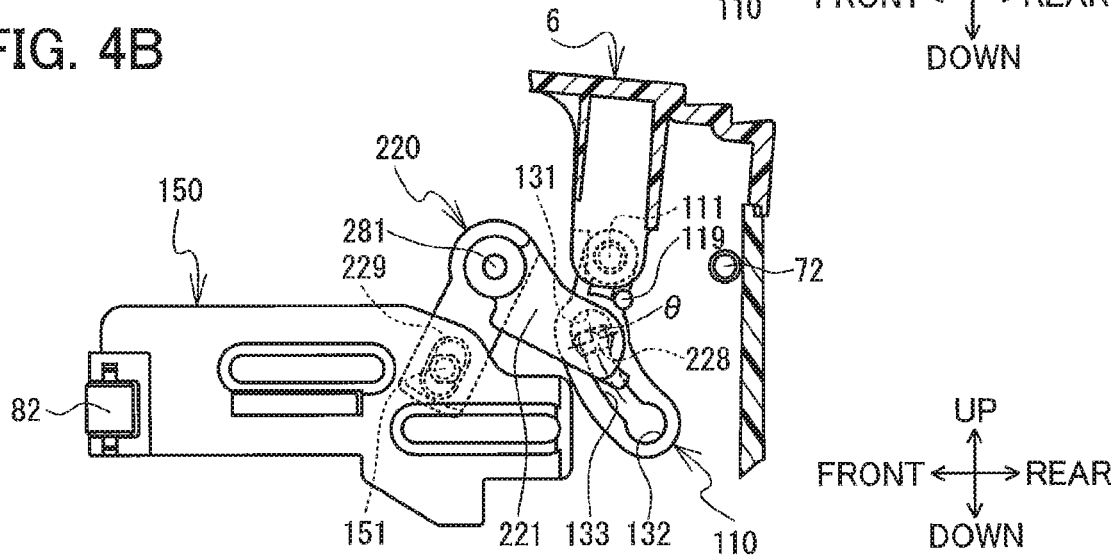
FIG. 4B is an explanatory view for explaining how the cover in the printer according to the embodiment is moved within the first movable range, and particularly illustrating a state where the first link is pivotally moved by an amount of a clearance provided between a first cam formed in the first link and a pin provided on the second cam.
Figure 4C:
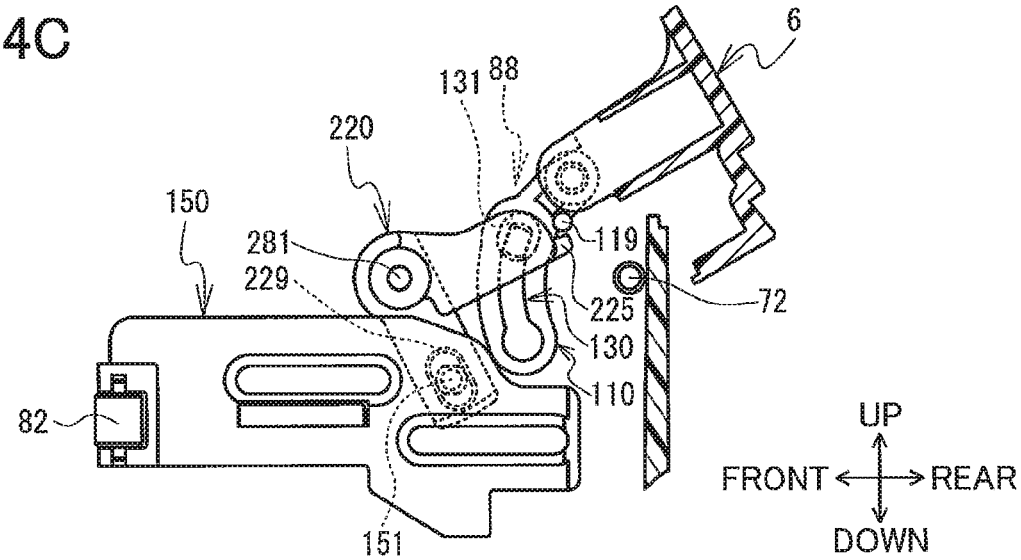
FIG. 4C is an explanatory view for explaining how the cover in the printer according to the embodiment is moved within the first movable range, and particularly illustrating a state where the second link is in its standby position.
Figure 5A:
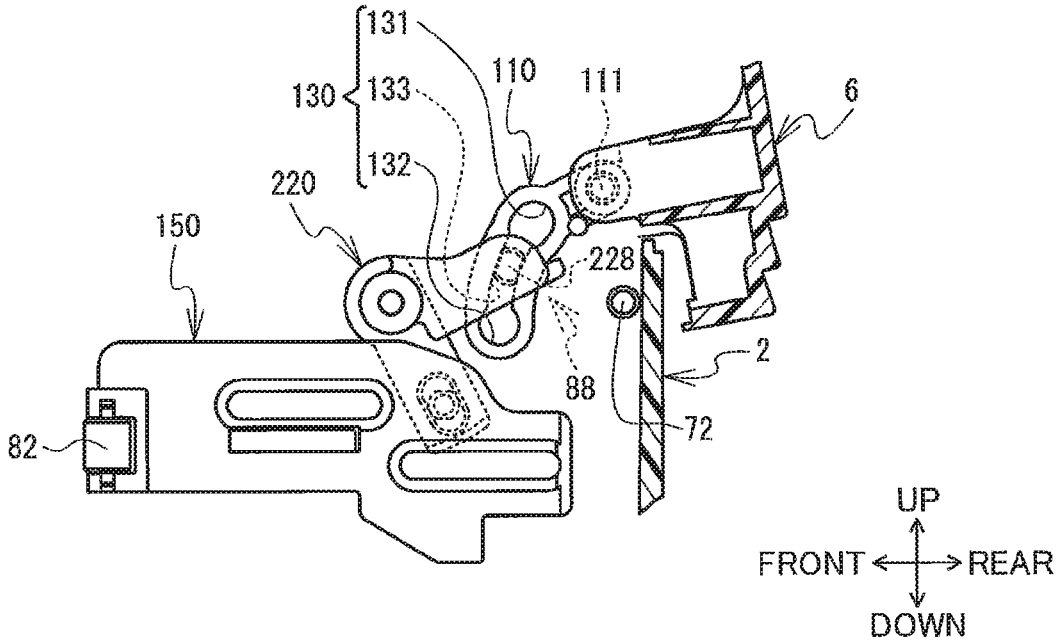
FIG. 5A is an explanatory view for explaining how the cover in the printer according to the embodiment is moved within a second movable range, and particularly illustrating a state where the pin is slidingly moved relative to a groove cam formed in the first link.
Figure 5B:
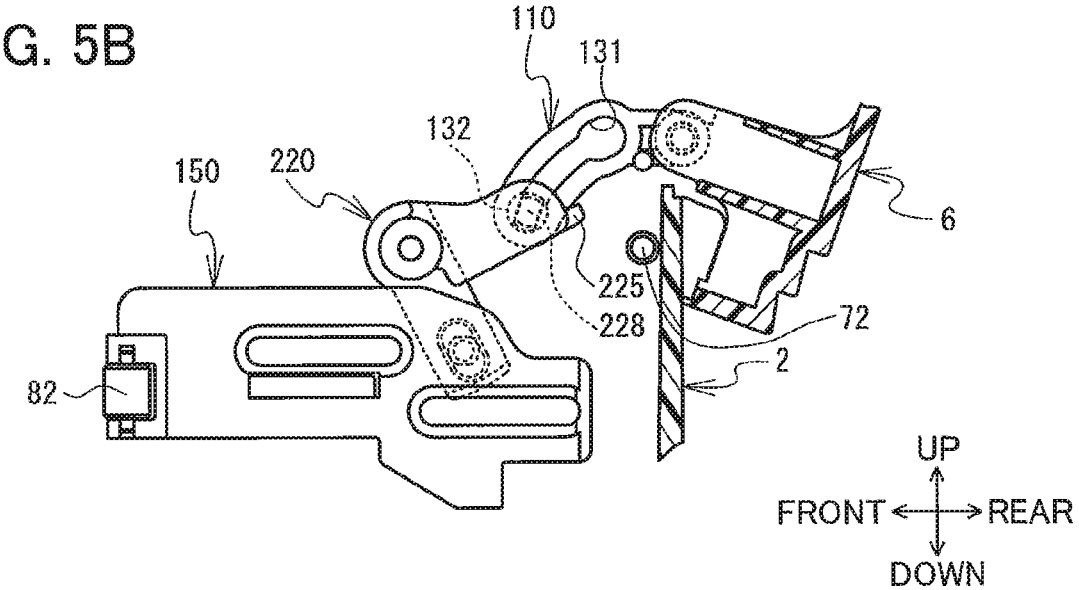
FIG. 5B is an explanatory view for explaining how the cover in the printer according to the embodiment is moved within the second movable range, and particularly illustrating a state where the cover is in its open position.

In the following description, of a range within which the cover 6 is pivotally movable (hereinafter also simply referred to as "movable range"), a movable range that includes the closed position of the cover 6 is referred to as "first movable range", and a movable range that includes the open position of the cover 6 is referred to as "second movable range". The first movable range is a range within which the cover 6 is pivotally moved as illustrated in FIGS. 4A to 4C, whereas the second movable range is a range within which the cover 6 is pivotally moved as illustrated in FIGS. 5A and 5B. The second movable range is different from the first movable range.

As illustrated in FIG. 1, a pair of bearing portions 7 arranged in the left-right direction is provided on the cover 6. Each of the pair of bearing portions 7 protrudes frontward in a state where the cover 6 is in the open position. Each of the pair of bearing portions 7 is formed of resin and is formed integrally with the cover 6. Each of the pair of bearing portions 7 is a plate like member having a rectangular shape as viewed in a side view, and has a protruding end portion formed with a pivot hole 7A penetrating the same in the left-right direction.

Next, a configuration for connecting the cover 6 and the platen holder 12 to each other will be described with reference to FIGS. 1 to 4A. The cover 6 and the platen holder 12 are connected to each other via a first link 110, a second link 220, and the movable member 150.

Figure 3:
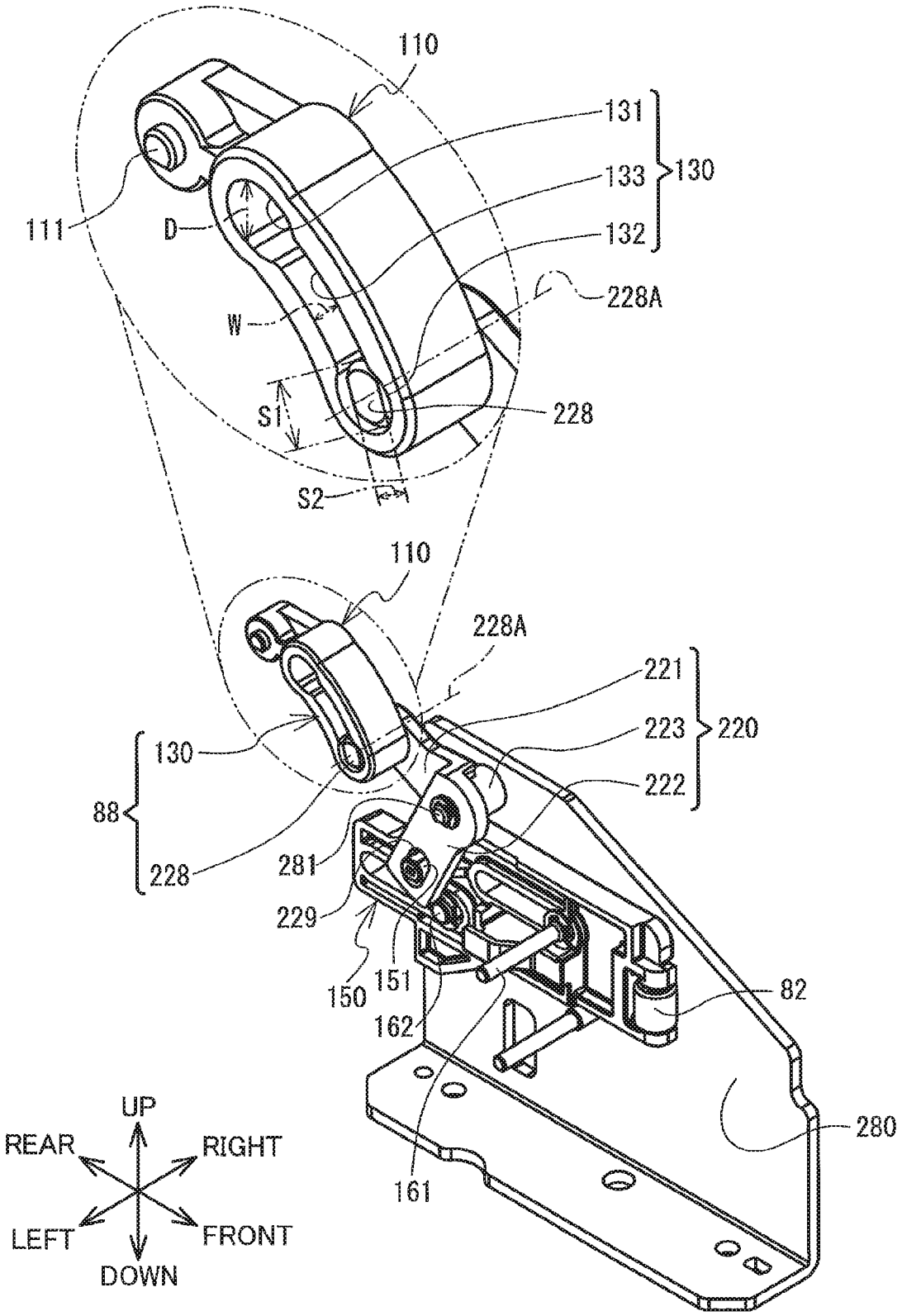
FIG. 3 is a perspective view of a first link, a second link, and a movable member in the printer according to the embodiment.

As illustrated in FIGS. 2 and 3, the first link 110 extends perpendicularly to the left-right direction while curving. The first link 110 has one end portion at which a pair of shaft portions 111 protruding outward in the left-right direction is provided. Each of the pair of shaft portions 111 is movably fitted into the corresponding one of the pair of pivot holes 7A (see FIG. 1). With this configuration, the first link 110 is supported by the cover 6 so as to be pivotally movable in interlocking relation to the pivotal movement of the cover 6.

As illustrated in FIGS. 3 and 4A, the first link 110 has another end portion at which a cam portion 130 is provided. In the present embodiment, the cam portion 130 is a hole that penetrates the first link 110 in the left-right direction, and includes a first cam 131, a second cam 132, and a groove cam 133.

The first cam 131 has a substantially circular arc shape formed in a first portion in the first link 110. In the present embodiment, the first portion corresponds to a point P1 in the first link 110 illustrated in FIG. 4A. The second cam 132 is provided in a second portion in the first link 110, and has a circular are shape substantially identical to the shape of the first cam 131. For example, the second portion corresponds to a point P2 in the first link 110 illustrated in FIG. 4A. The first portion and the second portion are displaced in accordance with a pivotal movement of the first cam 131. The groove cam 133 extends from the first cam 131 to the second cam 132 (i.e., to the second portion) to connect the first cam 131 and the second cam 132 to each other. The groove cam 133 has a shape that curves slightly frontward relative to an imaginary line connecting the point P1 to the point P2. The groove cam 133 has a groove width (a dimension W) smaller than an inner diameter (a dimension D) of the first cam 131.

Also, the first link 110 includes a protruding portion 119 (see FIG. 4A). The protruding portion 119 has a circular columnar shape and protrudes rightward at a position between the pair of shaft portions 111 and the cam portion 130.

As illustrated in FIG. 3, the second link 220 is pivotably movably supported by a pivot shaft 281 of a right plate 280 provided in an inner right portion of the housing 2 (see FIG. 1). That is, the second link 220 is pivotably movably supported by the housing 2. The second link 220 has a substantially L-shape as viewed in a side view, and includes a base portion 223, a first arm 221, and a second arm 222. The base portion 223 is formed with a through-hole (not illustrated) into which the pivot shaft 281 is fitted. With this configuration, the base portion 223 is rotatable about the pivot shaft 281. Each of the first arm 221 and the second arm 222 protrudes from the base portion 223.

The first arm 221 has a distal end portion on which a pin 228 is provided. Further, the second arm 222 has a distal end portion formed with a slot 229 extending substantially parallel to a direction in which the second arm 222 extends. The pin 228 protrudes from the distal end portion of the first arm 221, and is engaged with the cam portion 130. The pin 228 has an oblong cross-section taken along a plane perpendicular to the left-right direction in which a center axis 228A of the pin 228 extends. The pin 228 has a major diameter (a dimension S1) smaller than the inner diameter (the dimension D) of the first cam 131 and greater than the groove width (the dimension W) of the groove cam 133, and a minor diameter (a dimension S2) smaller than the groove width of the groove cam 133. The pin 228 is an example of a connecting portion of a connection member.

In the following description, the cam portion 130 and the pin 228 will also be correctively referred to as "connection member 88". The first link 110 and the second link 220 are connected to each other via the connection member 88.

An extension portion 225 (see FIG. 4A) is also provided on the distal end portion of the first arm 221. The extension portion 225 extends in a direction away from the pivot shaft 281. The pivot shaft 281 and the extension portion 225 provides a distance greater than a distance between the pivot shaft 281 and the pin 228. In other words, the extension portion 225 is positioned farther from the pivot shaft 281 than the pin 228 is from the pivot shaft 281 which serves as a pivot center of the second link 220. The extension portion 225 can abut against the protruding portion 119 of the first link 110.

Owing to the engagement of the pin 228 with the cam portion 130, the second link 220 is pivotally movable about the pivot shaft 281 between an operation position (see FIG. 4A) and a standby position (see FIG. 4C) in accordance with a pivotal movement of the first link 110. When the second link 220 is in the operation position, a direction of the major diameter of the pin 228 (hereinafter also referred to as "major diameter direction") extends substantially parallel to a direction of the groove width of the groove cam 133. When the second link 220 is in the standby position, a direction of the minor diameter of the pin 228 (hereinafter also referred to as "minor diameter direction") extends substantially parallel to the direction parallel to the groove width of the groove cam 133.

The first cam 131 formed in the first link 110 is configured to be engaged with the pin 228 of the second link 220 with a clearance therebetween (see FIGS. 4A and 4B). Here, "engaged with a clearance" denotes that there is a sufficient gap between the pin 228 and the first cam 131 to maintain the second link 220 stationary even when the first link 110 is pivotally moved by a certain amount (by an amount of the clearance). In other words, there is a little play between the first cam 131 and the pin 228.

The movable member 150 will be described next. The movable member 150 is a plate-like member having a rectangular shape extending in the front-rear direction as viewed in a side view. The movable member 150 is supported by support shafts 161 and 162 protruding leftward from the right plate 280 and is movable in the front-rear direction. The movable member 150 is provided with a projection portion 151 protruding leftward. The projection portion 151 is engaged with the slot 229 formed in the second link 220. Thus, as the second link 220 is pivotally moved about the pivot shaft 281, the movable member 150 is also moved in the front-rear direction.

The movable member 150 has a front end portion that holds the rotary roller 82. The rotary roller 82 is positioned rightward of the platen holder 12 (see FIG. 2) and is rotatable about an axis extending in the up-down direction. The rotary roller 82 is configured to press the inclined portion of the platen holder 12 urged by the torsion spring.

As the movable member 150 is moved frontward, the rotary roller 82 urges the inclined portion leftward while rolling on the inclined portion to cause the platen holder 12 to be pivotally moved toward its pressure position. As the movable member 150 is moved rearward, the rotary roller 82 rolls on the inclined portion, and thus the platen holder 12 is pivotally moved gradually toward the retracted position by an urging force of the torsion spring. In this way, movement of the movable member 150 in the front-rear direction causes the platen holder 12 to be pivotally moved between the pressure position and the retracted position.

Next, how the first link 110, the second link 220, and the platen holder 12 (see FIG. 2) are moved when the cover 6 is pivotally moved from the closed position to the open position will be described with reference to FIGS. 4A to 5B. When the cover 6 is in the closed position (see FIG. 4A), the first link 110 is at a lower end of a movable range thereof; the second link 220 is in the operation position; the movable member 150 is at a front end of a movable range thereof; and the platen holder 12 is in the pressure position (see FIG. 2). At this time, a lower end of the first cam 131 is positioned downward of and spaced apart from the pin 228.

Here, a positional relationship between the first link 110 and the pin 228 when the pin 228 is engaged with the first cam 131 will also be referred to as "first positional relationship", whereas the positional relationship therebetween when the pin 228 is engaged with the second cam 132 will also be referred to as "second positional relationship". That is, when the pin 228 is at the first portion of the first link 110 as illustrated in FIGS. 4A to 4C, the first link 110 and the pin 228 provides the first positional relationship therebetween. Similarly, when the pin 228 is at the second portion of the second link 220 as illustrated in FIG. 5B, the first link 110 and the pin 228 provides the second positional relationship therebetween.

As the user starts to open the cover 6, the cover 6 is pivotally moved within the first movable range toward the open position (see FIGS. 4A and 4B). The cover 6 pulls up the pair of shaft portions 111 of the first link 110, thereby moving the lower end portion of the first cam 131 upward toward the pin 228. In this state, the clearance between the first cam 131 and the pin 228 can keep the second link 220 stationary in the operation position.

After the first cam 131 is pivotally moved by the amount of the clearance, the lower end portion of the first cam 131 abuts against the pin 228 from the lower side thereof (see FIG. 4B). Since the major diameter of the pin 228 is greater than the groove width of the groove cam 133, the pin 228 is prevented from entering the groove cam 133. Therefore, the first cam 131 presses the pin 228 upward, whereby the second link 220 is pivotally moved from the operation position to the standby position (see FIGS. 4B and 4C).

While the second link 220 is pivotally moved, the pin 228 is rotated in the first portion inside the first cam 131. In other words, a posture of the pin 228 relative to the first cam 131 is changed. Specifically, while the pin 228 is rotated, a state where the major diameter direction of the pin 228 and a longitudinal direction of the groove cam 133 intersects with each other is maintained, but an angle θ (see FIG. 4B) defined between the major diameter direction of the pin 228 and the longitudinal direction of the groove cam 133 is changed.

At the same time, a pivotal movement of the second link 220 causes the slot 229 to press the projection portion 151 rearward, thereby moving the movable member 150 rearward. Accordingly, the platen holder 12 (see FIG. 2) starts to be pivotally moved from the pressure position to the retracted position due to the urging force of the torsion spring.

Then, the second link 220 reaches the standby position (see FIG. 4C), the movable member 150 reaches a rear end of the movable range thereof, and the platen holder 12 reaches the retracted position. At this time, the minor diameter direction of the pin 228 is substantially parallel to the groove width direction of the groove cam 133, and the pin 228 becomes movable into the groove cam 133. The extension portion 225 of the second link 220 is moved to a position closest to the protruding portion 119 of the first link 110 (see FIG. 4C). During the pivotal movement of the cover 6 within the first movable range, the positional relationship between the first link 110 and the pin 228 is maintained in the first positional relationship.

After reaching the state illustrated in FIG. 4C, the cover 6 is moved from the first movable range into the second movable range (see FIG. 5A). During the movement within the second movable range, the cover 6 continues to pull the pair of shaft portions 111 upward, and the pin 228 enters the groove cam 133. The pin 228 is slidingly moved relative to the groove cam 133 without changing its posture (i.e., without changing the angle θ), and thus the second link 220 is maintained in the standby position. Therefore, the movable member 150 remains stationary, and the platen holder 12 is maintained in the retracted position. Here, since the groove cam 133 is curved as described above, the pin 228 can be slidingly moved smoothly relative to the groove cam 133. That is, the positional relationship between the first link 110 and the pin 228 is changed from the first positional relationship toward the second positional relationship in accordance with the pivotal movement of the cover 6 within the second movable range.

Thereafter, the cover 6 reaches the open position (see FIG. 5B), and the first link 110 reaches an upper end of the movable range thereof. The pin 228 enters and is positioned within the second cam 132. At this time, the minor diameter direction of the pin 228 is substantially parallel to the groove width direction of the groove cam 133.

Next, how the first link 110, the second link 220, and the platen holder 12 are moved while the cover 6 is pivotally moved from the open position to the closed position will be described with reference to FIGS. 4A to 5B. When the cover 6 is pivotally moved from the open position to the closed position, the first link 110, the second link 220, and the platen holder 12 operate in the order of FIGS. 5B, 5A, 4C, 4B, and 4A. In short, when the cover 6 is pivotally moved from the open position to the closed position, the operation performed when the cover 6 is pivotally moved from the closed position to the open position described above is reversed.

As the user starts to close the cover 6, the cover 6 is pivotally moved within the second movable range from the open position toward the closed position as illustrated in FIGS. 5B and 5A. The first link 110 is pivotally moved downward in interlocking relation to the pivotal movement of the cover 6. Since the minor diameter direction of the pin 228 is substantially parallel to the groove width direction of the groove cam 133, the pin 228 is moved relatively from the second cam 132 into the groove cam 133, and is slidingly moved relative to the groove cam 133 to change the positional relationship between the first link 110 and the pin 228 from the second positional relationship toward the first positional relationship. At this time, the second link 220 remains stationary in the standby position, and the platen holder 12 (see FIG. 2) is maintained in the retracted position.

Concurrently with entry of the pin 228 into the first cam 131 (see FIG. 4C), the cover 6 is moved from the second movable range into the first movable range. At this time, the protruding portion 119 of the first link 110 moving downward in interlocking relation to the pivotal movement of the cover 6 comes closest to the extension portion 225 and abuts the same from the upper side. More specifically, the protruding portion 119 abuts the extension portion 225 to urge the same immediately before the inner side of the first cam 131 makes contact with the pin 228.

As the extension portion 225 is urged by the protruding portion 119, the second link 220 starts to be pivotally moved from the standby position toward the operation position. The slot 229 formed in the second link 220 presses the projection portion 151 frontward, whereby the movable member 150 is moved frontward to press the platen holder 12 to be pivotally moved from the standby position toward the pressure position.

While the extension portion 225 is moved away from the protruding portion 119 (see FIG. 4B), both ends in the major diameter direction of the pin 228 is brought into contact with the first cam 131. This contact causes the pin 228 to be rotated along with the first cam 131 in accordance with the pivotal movement of the first link 110 to cause the second link 220 to continue to be pivotally moved toward the operation position. At this time, as the pin 228 is in contact with and rotated inside the first cam 131, the positional relationship between the first link 110 and the pin 228 is maintained in the first positional relationship.

Eventually, the pin 228 is rotated so that the major diameter direction of the pin 228 becomes substantially parallel to the groove width direction of the groove cam 133 (see FIG. 4B). After the cover 6 and the first link 110 are further pivotally moved to displace the first cam 131 further downward, the cover 6 reaches the closed position (see FIG. 4A), the second link 220 reaches the operation position, and the platen holder 12 reaches the pressure position.

Next, a printing operation of the printer 1 will be described with reference to FIGS. 1 and 2. At the beginning of the printing operation, the tape cassette 60 is being attached to the attachment portion 8, and the cover 6 is being in the closed position (see FIG. 4A). When the conveying motor 33 starts to be driven, the ribbon take-up shaft 95, the drive shaft 100, and the platen roller 64 in the printer 1 are rotated. The ribbon drawn out from the ribbon spool and the printing medium 5 drawn out from the tape spool are brought into superposition on each other and pass the portion between the platen roller 64 and the printing head 10.

As the heat generating elements of the printing head 10 generate heat, ink contained in the ink ribbon is transferred onto the printing medium 5, whereby a character is printed on the printing medium 5. The used ribbon is taken up by the ribbon take-up spool 68. The printing medium 5 is nipped at the portion between the tape drive roller 46 and the conveying roller 66 and is conveyed thereby toward the discharge opening 11. After the driving of the conveying motor 33 is stopped, the cutting mechanism cuts the printing medium 5. Thus, the user can take out the printing medium 5 discharged through the discharge opening 11.

A method for assembling the first link 110 to both the second link 220 and the cover 6 will be described next with reference to FIGS. 1, 3 and 6. As described above, the cover 6 is pivotally movably supported by the pair of pivot portions 71; the second link 220 is pivotally movably supported by the pivot shaft 281; and the projection portion 151 of the movable member 150 is engaged with the slot 229 formed in the second link 220. At the time of assembly of the first link 110 to both the second link 220 and the cover 6, the cover 6 is maintained in the open position; the second link 220 is in the standby position; the movable member 150 is at the rear end of the movable range thereof; and the platen holder 12 is in the retracted position.

Figure 6:
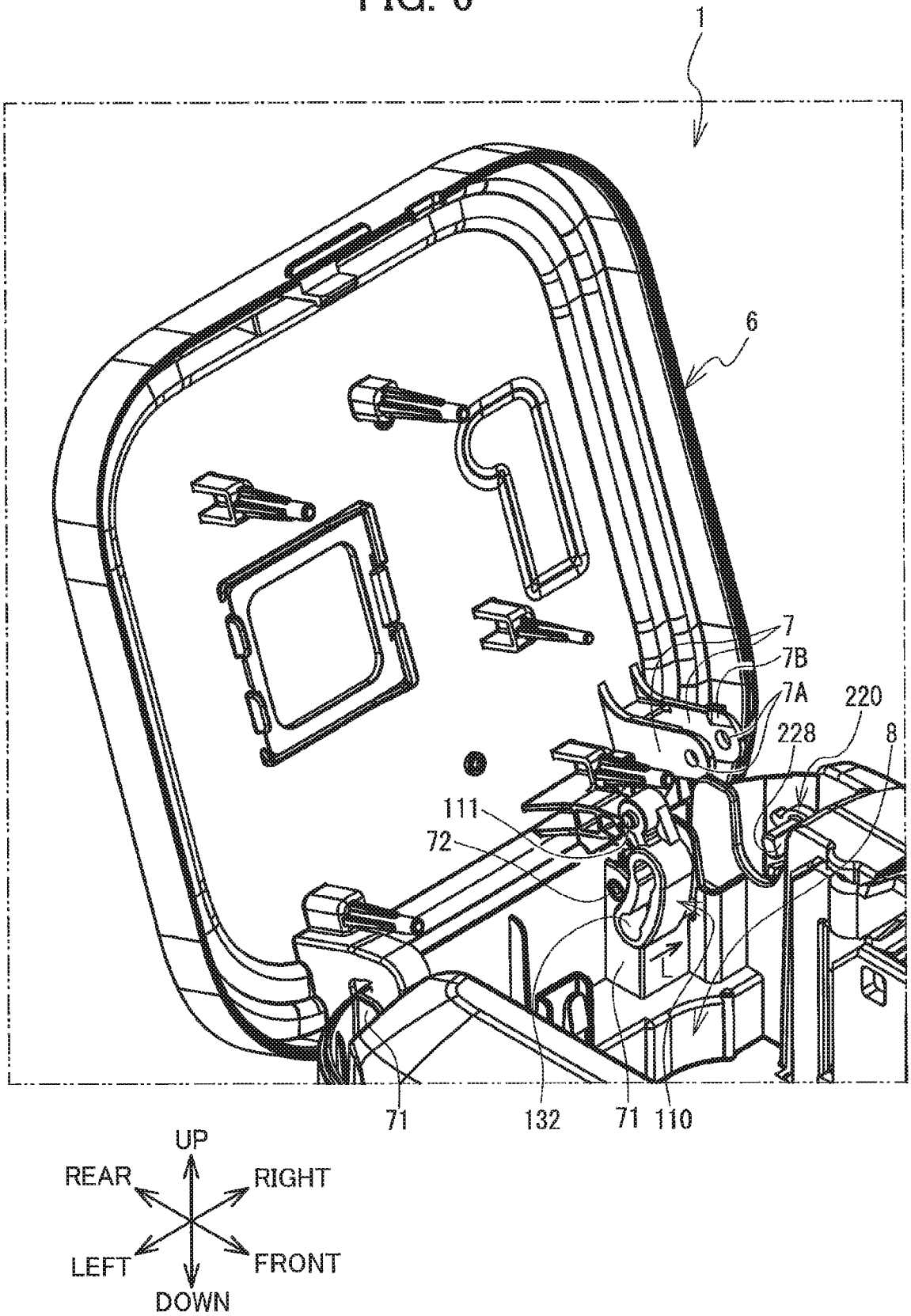
FIG. 6 is a perspective view of the first link in the printer according to the embodiment, and particularly illustrating a state prior to assembly of the first link to the second link and the cover.

An operator performing the assembly of the first link 110 places the first link 110 so that the second cam 132 is positioned to the left of the pin 228, and moves the first link 110 rightward as indicated by an arrow L in FIG. 6. Accordingly, the second cam 132 is engaged with the pin 228, and thus the first link 110 is connected to the second link 220. The operator then pivotally moves the first link 110 about the pin 228 and causes each of the pair of shaft portions 111 to be fitted into the pivot hole 7A in the corresponding one of the pair of bearing portions 7. In the detailed description that will be made below, the term "the pair of" is omitted to facilitate understanding of the sentence.

As illustrated in FIG. 6, each of the bearing portions 7 is formed with a beveled portion 7B formed on an inner side thereof. When the operator pivotally moves the first link 110 about the pin 228, each of the shaft portions 111 is brought into contact with the corresponding one of the beveled portions 7B. In this state, the operator pushes an upper end portion of the first link 110 toward the bearing portions 7. As a result, the beveled portions 7B are pressed outward by the shaft portions 111, thereby causing the bearing portions 7 to be elastically deformed to expand outward. As the bearing portions 7 expand outward, the shaft portions 111 can be moved from the beveled portions 7B toward the pivot holes 7A. When the shaft portions 111 reach the respective pivot holes 7A, the elastically deformed bearing portions 7 return to their original shape, and the shaft portions 111 can be respectively fitted into the pivot holes 7A.

In this way, by fitting the pair of shaft portions 111 into the corresponding one of the pair of pivot holes 7A, the first link 110 is brought into connection to the cover 6 and the assembly of the first link 110 is completed.

As described above, as the second link 220 is pivotally moved from the operation position to the standby position in accordance with the pivotal movement of the cover 6, the movable member 150 is moved to cause the platen holder 12 to be pivotally moved from the pressure position to the retracted position.

When the cover 6 is pivotally moved within the first movable range toward the open position, the connection member 88 causes the second link 220 to be pivotally moved from the operation position to the standby position in interlocking relation to the pivotal movement of the first link 110 while maintaining the pin 228 that connects the first link 110 and the second link 220 to each other at the first portion of the first link 110 (i.e., the positional relationship between the first link 110 and the pin 228 is maintained at the first positional relationship).

Further, when the cover 6 is pivotally moved within the second movable range toward the open position, the connection member 88 causes the pin 228 to be moved relatively from the first portion to the second portion of the first link 110 in accordance with the pivotal movement of the first link 110 (i.e., the positional relationship between the first link 110 and the pin 228 is caused to be changed from the first positional relationship to the second positional relationship), and maintains the second link 220 at the standby position.

With the above operation, while the cover 6 is pivotally moved, a disengagement of the pin 228 from the cam portion 130 is prevented and the connection member 88 can continue to connect the first link 110 and the second link 220 to each other, thereby enabling the platen holder 12 to be pivotally moved stably between the pressure position and the retracted position. Consequently, the printer 1 according to the present embodiment can stably change a positional relationship between the platen roller 64 and the printing head 10 in accordance with the movement of the cover 6 which serves an operation member operated by the user.

Further, as described above, the platen holder 12 starts to be moved from the pressure position at a timing when the cover 6 starts to open the attachment portion 8. With this configuration, the platen holder 12 can reach the retracted position promptly. Further, when the cover 6 is pivotally moved within the second movable range, the pivotal movement of the second link 220 is restricted to maintain the second link 220 at the standby position. Accordingly, an amount (i.e., the movable range) by which the first link 110 is pivotally moved can be increased. This configuration leads to an increase of an amount (i.e., the movable range) by which the cover 6 is pivotally moved, thereby allowing the attachment portion 8 to be open widely. As a result, the tape cassette 60 including the printing medium 5 can be easily attached to and detached from the attachment portion 8.

The cover 6 is configured to cover the attachment portion 8 so as to open and close the attachment portion 8 which serves an opening configured to accommodate the printing medium 5 therein. When the cover 6 pivotally moved from the closed position to the open position to open the attachment portion 8, the platen holder 12 is pivotally moved from the pressure position to the retracted position. Therefore, when the cover 6 is in the open position, the user can easily remove the tape cassette 60 including the printing medium 5 from the attachment portion 8 of the housing 2.

When the cover 6 is pivotally moved within the first movable range toward the open position, the connection member 88 maintains the pin 228 at the first portion (i.e., the first cam 131) of the first link 110, and causes the second link 220 to be pivotally moved from the operation position to the standby position by the rotation of the pin 228. When the cover 6 is pivotally moved within the second movable range, the second link 220 is positioned such that the major diameter direction of the pin 228 is substantially parallel to the longitudinal direction of the groove cam 133, and the pin 228 enters and is slidingly moved relative to the groove cam 133.

Since the major diameter direction of the pin 228 and the longitudinal direction of the groove cam 133 intersect with each other (see FIGS. 4A and 4B) during the pivotal movement of the cover 6 within the first movable range, the pin 228 is prevented from entering the groove cam 133. The pin 228 can be moved relatively into the groove cam 133 at a timing when the cover 6 is moved from the first movable range into the second movable range (see FIGS. 4C and 5A). Further, when the cover 6 is pivotally moved within the second movable range, the pin 228 is slidingly moved relative to the groove cam 133, and thus the rotation of the pin 228 is restricted by the groove cam 133. With this configuration, the connection member 88 can maintain the second link 220 at the standby position with ease.

The pin 228 has a substantially oblong cross-section taken along a plane perpendicular to the left-right direction in which the center axis 228A of the pin 228 extends. This simple shape of the pin 228 allows the printer 1 to simplify the configuration of the connection member 88.

At a timing when the cover 6 is moved from the second movable range into the first movable range, the protruding portion 119 presses the extension portion 225 to cause the second link 220 in the standby position to be pivotally moved toward the operation position (see FIG. 4C). That is, when the cover 6 is moved from the second movable range into the first movable range, the protruding portion 119 of the first link 110 presses the extension portion 225 positioned farther from the pivot shaft 281 than the pin 228 is from the pivot shaft 281 which serves as the pivot center of the second link 220. Accordingly, the second link 220 can start the pivotal movement smoothly from the standby position toward the operation position.

The first cam 131 is engaged with the pin 228 with a clearance provided therebetween. When the cover 6 starts to be pivotally moved from the closed position, the first cam 131 formed in the first link 110 is moved by the amount of the clearance and then contacts to move the pin 228 upward. In other words, while the first cam 131 of the first link 110 is moved by the amount of the clearance, the pivotal movement of the second link 220 is prevented, and the movement of the movable member 150 is also prevented. This configuration can reduce an operation load applied when the user starts to open the cover 6. Accordingly, a force needed when the user starts to open the cover 6 can be reduced, whereby the user can easily open the cover 6.

The cam portion 130 includes the second cam 132. When the printer 1 is assembled together (i.e., when the first link 110 is assemble to the second link 220 and the cover 6), the pin 228 of the second link 220 is first engaged with the second cam 132 to allow the second link 220 and the first link 110 to be connected to each other. Accordingly, the assembly of the printer 1 can be facilitated.

While the description has been made in detail with reference to the embodiment, it would be apparent to those skilled in the art that various changes and modifications may be made thereto.

For example, while the cam portion 130 is in a form of a hole in the above-described embodiment, the cam portion 130 may be a cam surface formed at an outer peripheral edge surface of the first link 110. In this case, the second link 220 may be urged by an elastic member so that the pin 228 is pressed against the cam surface. Further, the groove cam 133 may have a linear shape instead of a curved shape.

The cover 6 is provided at the housing 2 so as to be pivotally movable relative to the housing 2. However, the cover 6 may be provided at the housing 2 so as to be slidably movable relative to the housing 2. Further, instead of the cover 6, the printer 1 may include a lever. The lever need not be capable of opening and closing an opening (i.e., the attachment portion 8) provided in the housing 2 as long as the lever is an operation member that is movable in response to the user's operation. While the first cam 131 and the pin 228 are engaged with each other with a clearance therebetween in the above-described embodiment, such the clearance may not be provided between the first cam 131 and the pin 228.

Further, in the above-described embodiment, the pin 228 provided on the second link 220 has a substantially oblong cross-section taken along a plane perpendicular to the left-right direction. Instead of the above shape, the pin 228 may have an arbitrary cross-section such as a substantially oval cross-section, a substantially ellipse cross-section, a substantially rectangular cross-section, or a substantially polygonal cross-section, as long as the cross-section of the pin 228 has a major diameter and a minor diameter substantially the same as those of the pin 228 described above.

Figure 7:
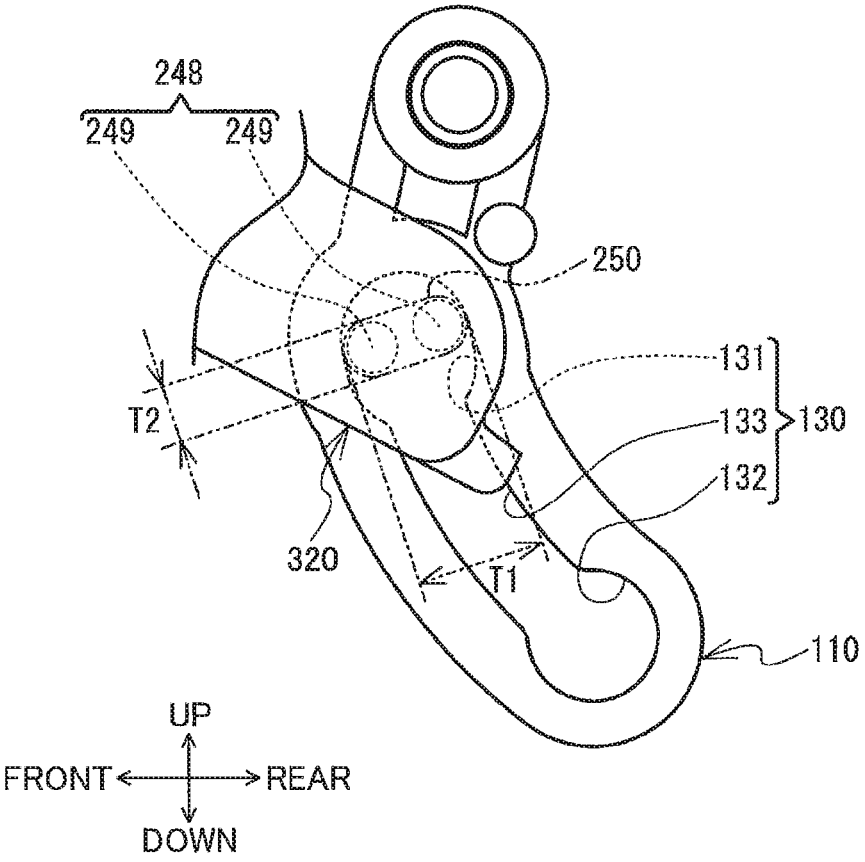
FIG. 7 is a right side view of a set of pins provided on a second link in a printer according to a modification.

FIG. 7 illustrates a modification to the embodiment in which the shape of the pin is different from that in the above-described embodiment. In this modification, a second link 320 that includes a set of pins 248 consisting of two pins 249 is provided instead of the second link 220. That is, the pin 228 is not provided on the second link 320. Each of the two pins 249 has a circular columnar shape.

The two pins 249 form an imaginary elongated circle 250. The elongated circle 250 has a major diameter (a dimension T1) smaller than the inner diameter of the first cam 131 and greater than the groove width of the groove cam 133, and a minor diameter (a dimension T2) smaller than the groove width of the groove cam 133. Even with the above configuration, the set of pins 248 is prevented from entering the groove cam 133 when the second link 320 is in the operation position (see FIG. 7), and the set of pins 248 is allowed to be moved into the groove cam 133 when the second link 320 is in the standby position (see FIG. 4C).

Further, the cam portion 130 formed in the first link 110 may not include the second cam 132. In this case, the cam portion 130 has a shape in which the groove cam 133 is extended to replace the second cam 132.

However, with the above configuration in which the second cam 132 is dispensed with, the first link cannot be assembled in accordance with the method described above. In order to assemble the first link to both the second link 220 and the cover 6 in a different method, the first link includes a through-hole instead of the pair of shaft portions 111. The through-hole has a diameter equal to a diameter of each pivot hole 7A. Hereinafter, the first link without the second cam 132 and formed with the through-hole is referred to as "specific first link". A shaft to be inserted into the through-hole and the pivot holes 7A is needed separately. The shaft has a length greater than a distance in the left-right direction between the pair of bearing portions 7.

A method of assembly of the specific first link will be described. The operator places the specific first link to the left of the pin 228. Then, the operator moves the specific first link rightward and causes the pin 228 to be engaged with the groove cam 133 at a position close to a distal end of the groove cam 133. Thereafter, the operator moves the specific first link to a position where the through-hole formed in the specific first link is aligned with the pivot holes 7A in the left-right direction. With the positions of the through-hole and the pivot holes 7A aligned with each other, the shaft is inserted into the through-hole and the pivot holes 7A. Thereafter, a retaining ring is fixed to each of ends of the shaft protruding outward of the bearing portions 7, and the assembly of the specific first link is completed.

What is claimed is:

1. A printer comprising:

a housing;

a platen holder accommodated in the housing and movable between a pressure position and a retracted position;

a platen roller rotatably supported by the platen holder;

a printing head configured to nip a printing medium in cooperation with the platen roller to perform printing on the printing medium, the platen roller pressing the printing head when the platen holder is at the pressure position, the platen roller being spaced apart from the printing head when the platen holder is at the retracted position;

an operation member provided at the housing and movable relative to the housing within a first movable range and within a second movable range different from the first movable range;

a first link pivotally movably supported by the operation member, the first link having a first portion and a second portion different from the first portion;

a second link supported by the housing and pivotally movable between an operation position and a standby position;

a connection member having a connecting portion at which the first link and the second link are connected to each other, the first link and the connecting portion providing therebetween a positional relationship including a first positional relationship at the first portion of the first link and a second positional relationship at the second portion of the first link; and a movable member movable in interlocking relation to a pivotal movement of the second link from the operation position to the standby position to move the platen holder from the pressure position to the retracted position, wherein, when the operation member is moved within the first movable range, the connection member causes the second link to be pivotally moved from the operation position to the standby position in response to a pivotal movement of the first link while maintaining the first positional relationship between the first link and the connecting portion, and wherein, when the operation member is moved within the second movable range, the connection member causes the positional relationship between the first link and the connecting portion to be changed from the first positional relationship to the second positional relationship in response to the pivotal movement of the first link while maintaining the second link at the standby position.

2. The printer according to claim 1, wherein the housing is formed with an opening configured to accommodate the printing medium therein, wherein the operation member is a cover supported by the housing and pivotally movable between an open position in which the opening is open and a closed position in which the opening is closed by the cover, wherein the first movable range is a range including the closed position of the cover, and wherein the second movable range is a range including the open position of the cover.

3. The printer according to claim 2, wherein the connection member comprises:

a cam portion provided at the first link, the cam portion comprising:

a first cam provided at the first portion of the first link and has a substantially circular arc shape; and a groove cam extending from the first cam to connect the first cam to the second portion of the first link, the groove cam having a groove width smaller than an inner diameter of the first cam; and a pin provided at the second link and engaged with the cam portion, the pin having a major diameter and a minor diameter smaller than the major diameter, the major diameter being smaller than the inner diameter of the first cam and greater than groove width of the groove cam, the minor diameter being smaller than the groove width of the groove cam, wherein, in accordance with a pivotal movement of the cover within the first movable range, the pin is rotated in response to the pivotal movement of the first link inside the first cam while a direction of the major diameter intersects a longitudinal direction of the groove cam such that an angle defined between the direction of the major diameter and the longitudinal direction of the groove cam is changed, and wherein, in accordance with the pivotal movement of the cover within the second movable range, the second link is in a posture where the direction of the major diameter extends substantially parallel to the longitudinal direction of the groove cam, and the pin is moved from the first cam into the groove cam and is slidingly moved relative to the groove cam.

4. The printer according to claim 3, wherein the pin has a substantially oblong cross-section taken along a plane perpendicular to a direction in which a center axis of the pin extends.

5. The printer according to claim 3, wherein the first link comprises a protruding portion, wherein the second link has a pivot center and comprises an extension portion positioned farther from the pivot center of the second link than the pin is from the pivot center, and wherein, at a timing when the cover is moved from the second movable range into the first movable range, the protruding portion presses the extension portion to cause the second link in the standby position to be pivotally moved toward the operation position.

6. The printer according to claim 3, wherein the pin is engaged with the first cam with a clearance therebetween.

7. The printer according to claim 3, wherein the cam portion further comprises a second cam positioned at the second portion of the first link, the second cam having a substantially circular arc shape substantially the same as the shape of the first cam.

* * * * *